US005746033A

United States Patent [19]

Chuang

[11] Patent Number: 5,746,033

[45] Date of Patent: May 5, 1998

[54] METHOD FOR CONSTRUCTING ONE-STEP GROUP FIXED WINDOW FRAMES IN A CONCRETE-STRUCTURED BUILDING

[76] Inventor: Yung-Chuan Chuang, No. 142, Shin Fuh Road, Feng Shan City, Kaohsung County, Taiwan

[21] Appl. No.: 518,396

[22] Filed: Aug. 15, 1995

Related U.S. Application Data

[62] Division of Ser. No. 179,702, Jan. 11, 1994, Pat. No. 5,458,828.

[51] Int. Cl.[6] ..... E06B 1/04; E04G 15/00

[52] U.S. Cl. ..... 52/213; 52/204.1; 52/208; 52/656.1; 52/745.15; 249/39

[58] Field of Search ..... 52/204.1, 208, 52/212, 213, 215, 204.5, 656.1, 656.5, 656.6; 249/39, 112; 264/35, 219; 454/243, 244, 270, 271

[56] References Cited

U.S. PATENT DOCUMENTS

| | | | |
|---|---|---|---|
| 1,326,400 | 12/1919 | Halverson et al. | 264/35 X |
| 1,863,549 | 6/1932 | Lockwood | 249/39 X |
| 2,787,820 | 4/1957 | Shield et al. | 249/39 |
| 3,994,243 | 11/1976 | Anders | 52/212 X |
| 4,138,084 | 2/1979 | Reid | 249/39 X |
| 4,430,831 | 2/1984 | Kemp | 249/39 X |
| 4,470,222 | 9/1984 | Killingsworth | 52/717.02 X |
| 4,478,535 | 10/1984 | Kennedy et al. | 52/204.1 X |
| 4,589,624 | 5/1986 | Jones | 52/215 X |
| 5,261,202 | 11/1993 | Brunet et al. | 52/202 |
| 5,460,572 | 10/1995 | Waltz et al. | 454/271 X |

FOREIGN PATENT DOCUMENTS

| | | |
|---|---|---|
| 0631564 | 11/1961 | Canada . |
| 2330141 | 1/1975 | Germany . |
| 0608650 | 5/1978 | U.S.S.R. . |

*Primary Examiner*—Carl D. Friedman
*Assistant Examiner*—Winnie Yip
*Attorney, Agent, or Firm*—Morton J. Rosenberg; David I. Klein

[57] ABSTRACT

A construction method for one-step grout fixed window frames on external walls of a concrete-structured building includes the following steps. A window frame including vertical and horizontal sections is fixed with vertical lining boards to the inner side of its vertical sections to form a window frame assembly, and is then supported on an upper supporting board which has been securely attached to a concrete template of an external wall of the building. Template sealing strips are separately attached to an exterior edge and an interior edge of the vertical sections and the upper horizontal section of the window frame assembly, so that a complete molding cavity is formed. Into this molding cavity the grouting concrete is grouted and the window frame is inlaid in the concrete after the concrete is set and the concrete templates are removed. With this one-step grout fixed window frame construction method, the periphery of window frames is given good waterproof ability and beautiful appearance, and the construction cost and term are both reduced.

1 Claim, 9 Drawing Sheets

METHOD FOR CONSTRUCTING ONE-STEP GROUP FIXED WINDOW FRAMES IN A CONCRETE-STRUCTURED BUILDING

This is a divisional of copending application Ser. No. 08/179,702 filed on Jan. 11, 1994.

BACKGROUND OF THE INVENTION

The present invention relates to a method for constructing one-step grout fixed window frames on the external walls of a concrete-structured building. The main purpose of the present invention is to provide the building with good waterproof ability around the peripheral concrete wall of the window frames so that the windows are free of water permeance at their pheriphery. The above construction method is developed based on the technical concept that the concrete sets after being grouted, and that grouting concrete in one step avoids the overlapped construction joints which are usually found in double or repeat grouting of concrete. Based on this concept, the templates for forming the concrete external wall of the building are so designed that they together with a window frame fixed to them in advance form a complete moulding cavity, allowing one-step grouting of concrete to directly inlay the window frame or frames into the structural concrete external wall of the building, and thereby eliminating construction joints of concrete from the exterior of the building. By this way, the concrete set in one time may fully extend its sealing effect to provide waterproof external walls around the periphery of window frames and the windows are free of peripheral water permeance. Moreover, window frames can be more conveniently located at any desired positions on the building without deformation.

It is known that the quality, construction cost, and the term of construction of a concrete-structured building are influenced by the template works, and that, due to some of the not yet overcome technical problems concerning the installation of windows of such building, such as the window frames are subject to overpressure from the grouting concrete, conventional template works of general concrete-structured building need to reserve window openings on the external walls so that window frames are installed after the completion of the entire concrete structure.

When mounting a window frame to the opening reserved on the concrete external wall, cement-sand grout must be used to fill the gaps between the opening and the window frame and the grooves surrounding the window frame and finishing works must be done for several times. Such works cause not only overlapped construction joints, but also non-waterproof and water-permeable areas around the periphery of windows due to rather loose and water-absorbing cement grout which is not a structural material. As a result, other water-repelling works, such as paving mosaic or tiles, applying PU paint, and applying silicone sealant around the window frames, must be additionally done. Although the purpose of such additional works are said to upgrade the constructional quality, construction cost and term are inevitably increased, forming an unnecessary waste.

It is therefore tried by the inventor to develop a new construction technique and method to overcome the above mentioned disadvantages existed in the conventional concrete building construction so that the installation of window frames can be completed at the same time the template works proceed, and the additional labor cost and degraded work quality that would otherwise occur in the second stage of window frame installation can be reduced.

SUMMARY OF THE INVENTION

A primary object of the present invention is to provide a method for constructing one-step grout fixed window frames on the external wall of a concrete-structured building. In this method, a window frame is attached in advance to the templates for an external wall at where a window is to be mounted so that the external wall templates together with the attached window frame form a complete moulding cavity that allows the grouting of concrete and the fixation of window frame on a structural external wall of the building to be done in one single step and therefore, no construction joints are left on the exterior wall while the inherited water resistance of concrete can be best extended. No additional cement-sand grouting, finishing works, and water-repelling works are required at later stage of construction.

A further object of the present invention is to provide a method for constructing one-step grout fixed window frames on the external wall of a conrete-structured building, in which template sealing strips used at an exterior edge of two vertical sections of the window frame are so designed that they form a joint of the fixed window frame and the peripheral concrete wall having an outward inclined surface which facilitates the removal of the templates and the seal strips after the concrete is set, and provides smooth and beautiful concrete finish around the window frame.

A still further object of the present invention is to provide a method for constructing one-step grout fixed window frames on the external wall of a concrete-structured building in which, after the concrete grout is set, the interior joint of the window frame and the peripheral concrete wall is higher than the exterior joint of the window frame and the peripheral concrete wall and therefore, water can be better prevented from overflowing into the window.

BRIEF DESCRIPTION OF THE DRAWINGS

The above and other features and functions of the present invention can be best understood by referring to the following detailed description of the preferred embodiment and the accompanying drawings, wherein.

DETAILED DESCRIPTION OF THE PREFERRED EMBODIMENTS

Figure 1:
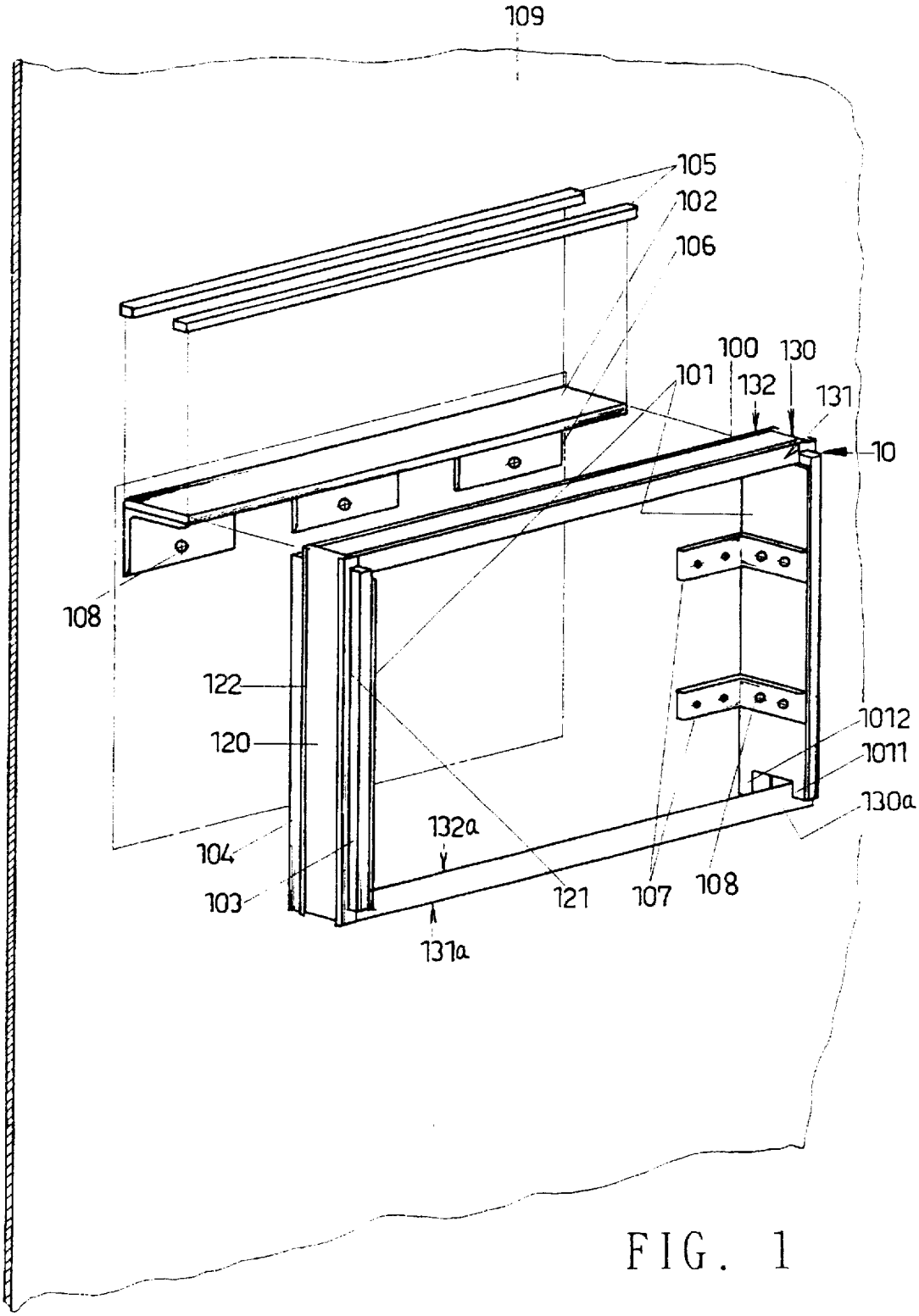
FIG. 1 is a partially disassembled view showing that an upper supporting plate and matching angle brackets according to the present invention are mounted to an external wall template to support a window frame thereon and that flexible template sealing strips are mounted on an interior and an exterior edge of the upper horizontal section of the window frame.
Figure 2:
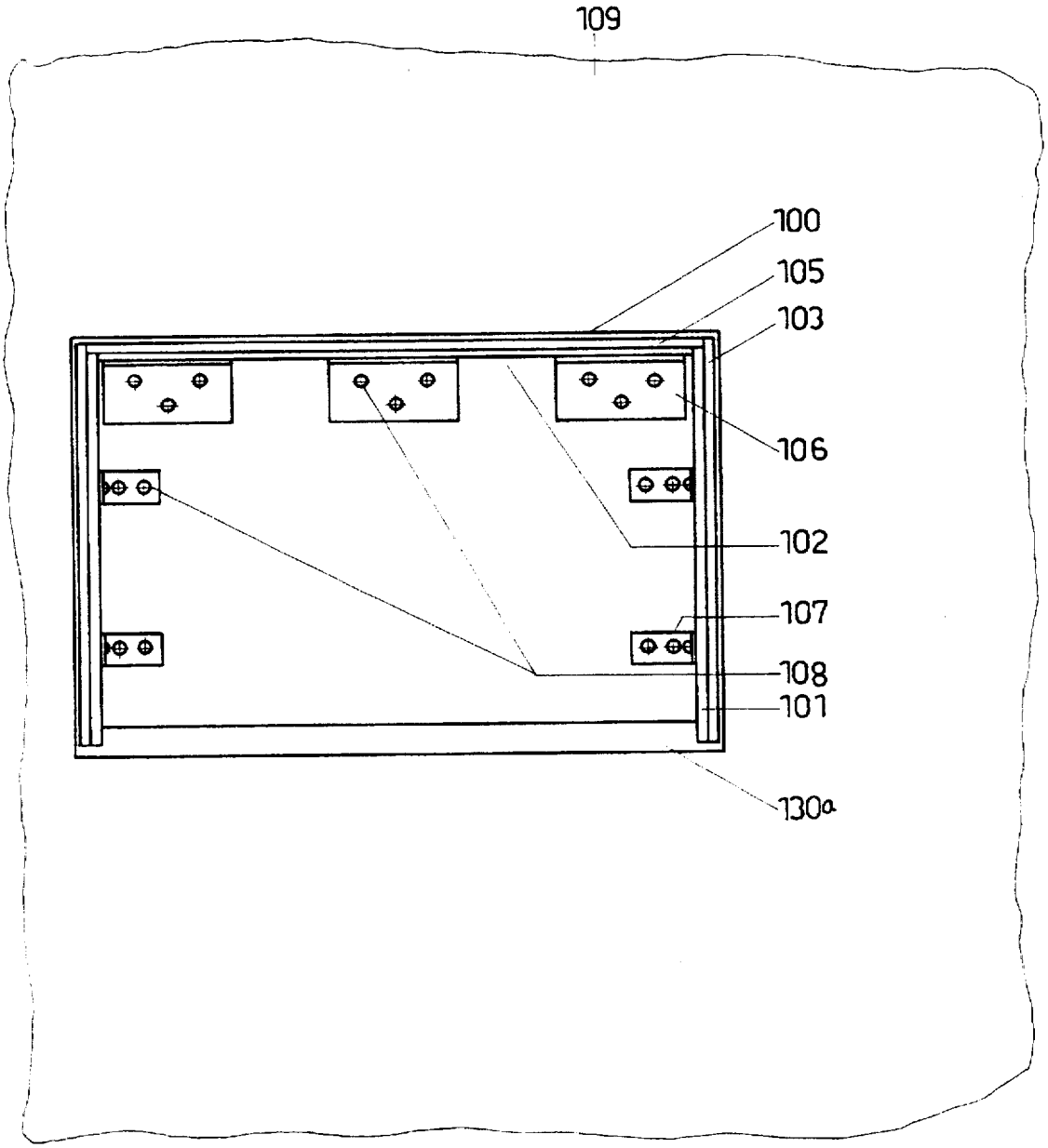
FIG. 2 is an elevational plan view showing the window frame of FIG. 1 having been attached to the concrete external wall template according to the method of the present invention.

Please refer to FIG. 1, the main object of the present invention is to include a window frame in the concrete templates of the external wall of a concrete-structured building so that the concrete templates of the building act as a complete moulding cavity for grouting concrete. Since the template works for a concrete-structured building is a known art, it is not described in details herein. In FIG. 1, a window frame 100 having two vertical sections 120, an upper horizontal section 130, and a lower horizontal section 130*a*, together with two vertical lining boards 101 fixed to an inner side of the two vertical sections 120 and a pair of template sealing strips 103, 104, respectively fixed to an interior edge 121 and an exterior edge 122 of the vertical sections 120, form a window frame assembly 10 to be attached to a concrete template 109 at where a window is to be formed on the external wall of a concrete-structured building. An upper frame supporting board 102 is first securely attached to the concrete template 109 by means of matching angle brackets 106 which are fixed to the concrete template 109 at predetermined positions by bolts or nails 108. The window frame assembly 10 is supported on the upper frame supporting board 102 and is then fixed to the concrete template 109. Two template sealing strips 105 are then disposed on the upper supporting board 102 and separately attached to an interior edge 131 and an exterior edge 132 of the upper horizontal window section 130, which is now lying on the upper supporting board 102, such that the sealing strips 105 fill in the gaps between the upper window section 130 and the concrete templates. FIG. 2 is an elevational plan view showing the window frame assembly 10 that has been attached to the concrete template 109 and the positions of other mounting members needed to complete such attachment.

It can also be seen from FIGS. 1 and 2 that the window frame assembly 10 is fixed to the concrete template 109 by means of angle brackets 107 which are fixed at one leg to the vertical lining boards 101 of the window frame assembly 10 and at another leg to the concrete template 109 by bolts or nails 108. As it can be clearly seen from FIG. 2, both the upper supporting board 102 and the vertical lining boards 101 are flatly fitted to the inner side of the horizontal section 130 and the vertical sections 120 of the window frame 100, respectively. There is not any template sealing strip to be attached to either edge of the lower horizontal section 130*a* of the window frame 100, so that an opening 111 is kept at the bottom of the window frame 100 acting as a vent or a passage for filling more concrete grout in the event the concrete grouted is not enough.

Figure 3:
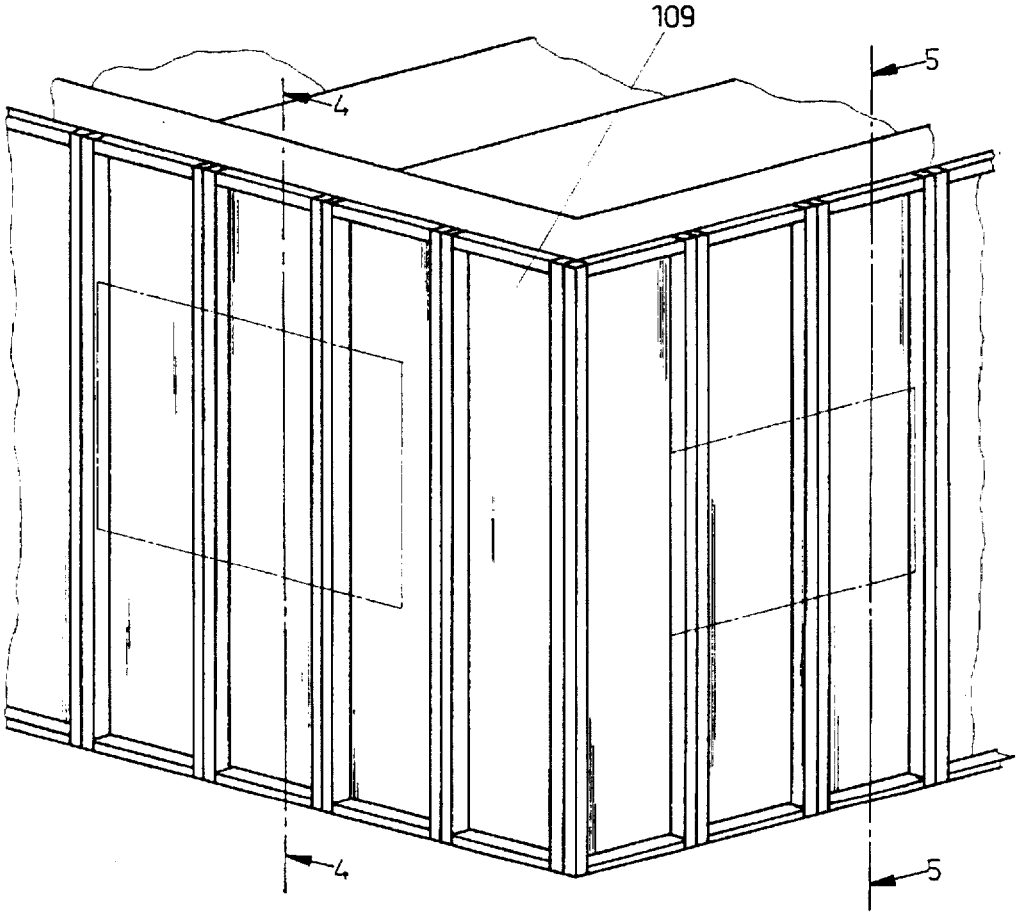
FIG. 3 is a partial perspective showing the locations where the window frames can be attached to the templates according to the method of the present invention.
Figure 4:
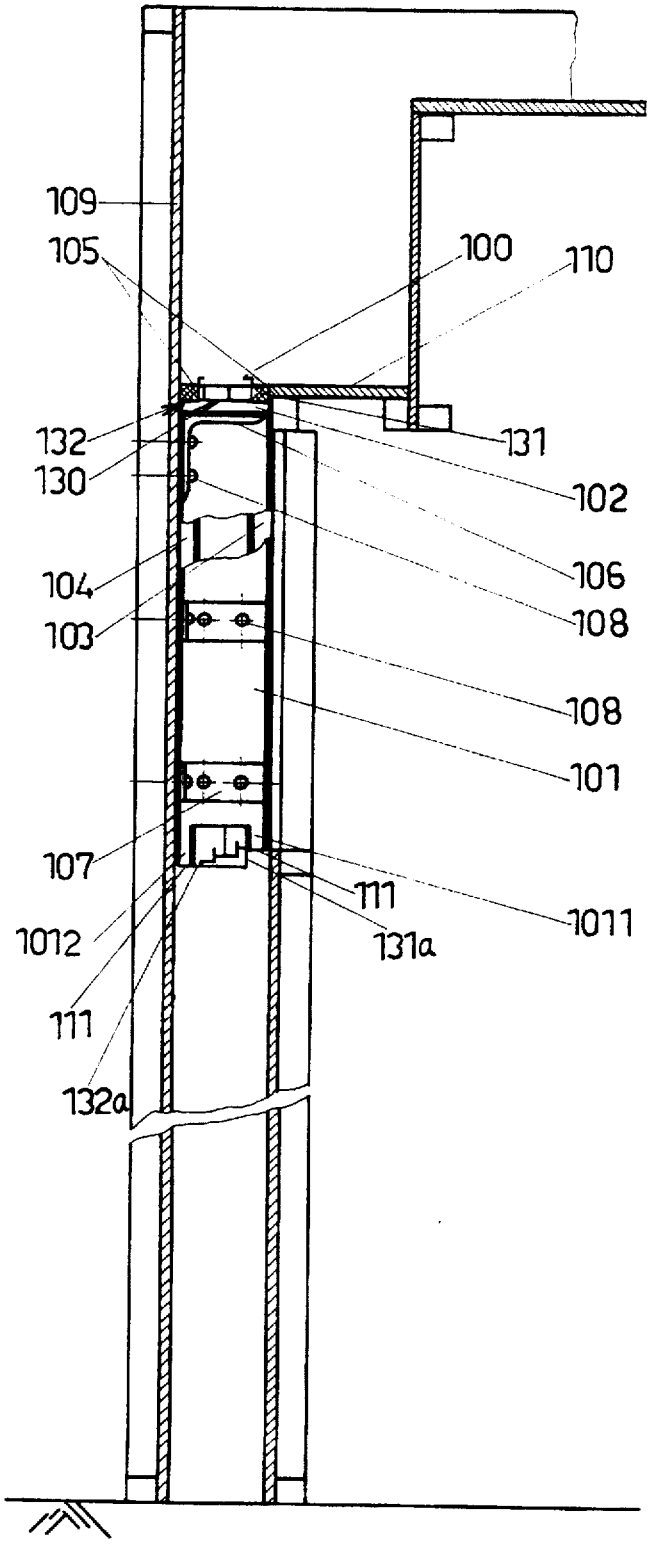
FIG. 4 is a sectional view taken on the line 4—4 of FIG. 3.

Referring to FIGS. 3 and 4, the window frame assembly 10 attached to the concrete template 109 according to the present invention is located just below a concrete template 110 of a concrete beam. From FIGS. 3 and 5, the window frame assembly 10 attached to the concrete template 109 according to the present invention can also be located at some distance from the beam. That is, the window frame assembly 10 according to the present invention may be freely located at many different places in a concrete-structured building.

Figure 5:
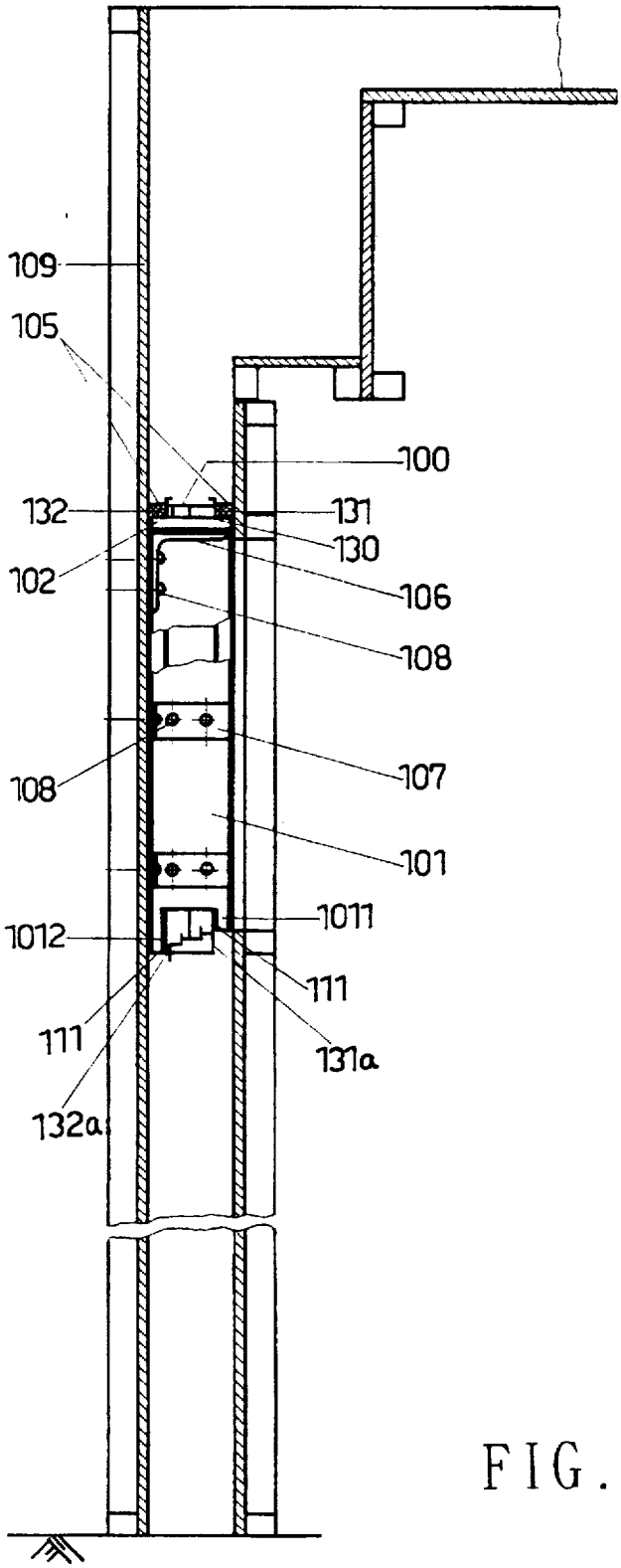
FIG. 5 is a sectional view taken on the line 5—5 of FIG. 3.
Figure 6:
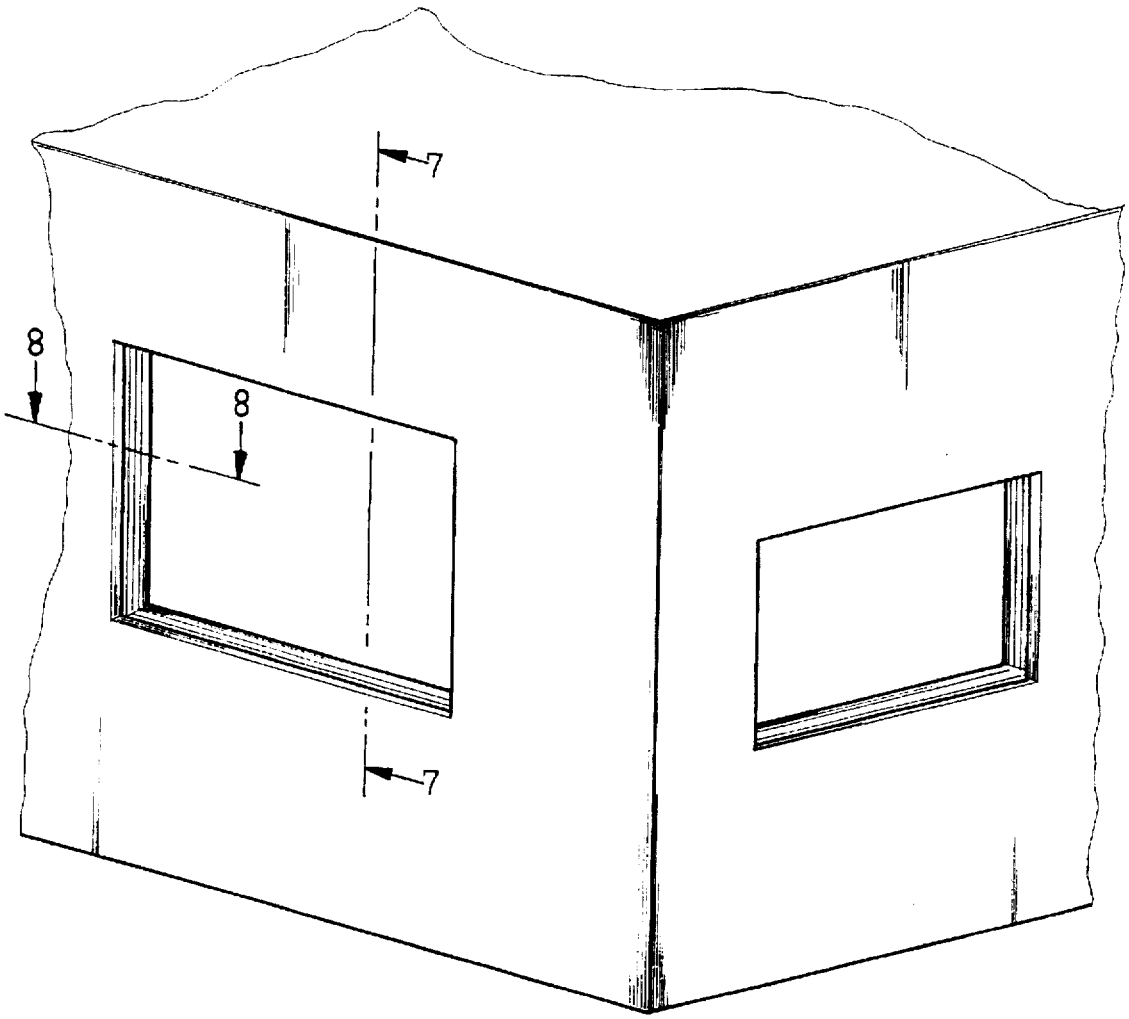
FIG. 6 is a partial perspective showing window frames being grout fixed to the walls according to the present invention are inlaid into the concrete wall after the templates are removed.
Figure 7:
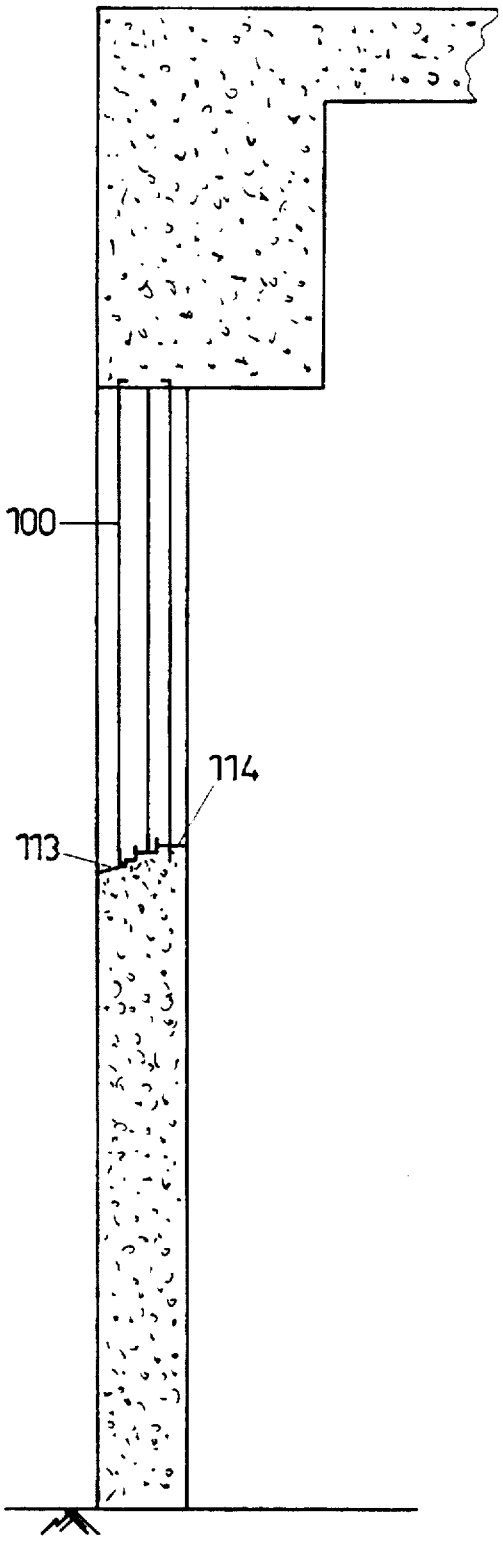
FIG. 7 is a sectional view taken on the line 7—7 of FIG. 6, showing the interior joint of the lower window section and the concrete wall is higher than their exterior joint.

From FIGS. 4 and 5, it can be seen that the window frame 100 is positioned in place within the enclosing concrete wall templates by means of flexible template sealing strips 103, 104, and 105. The space left between the whole outer periphery of the window frame 100 and the enclosing templates becomes a complete moulding cavity. In the event there is not sufficient grouting concrete at the bottom of the window assembly 10, additional grouting concrete may be filled through the lower opening or vent 111 left at the lower end of the window frame 100. FIG. 6 shows two window frames 100 fixedly inlaid in a concrete wall after the templates are removed.

Figure 8:
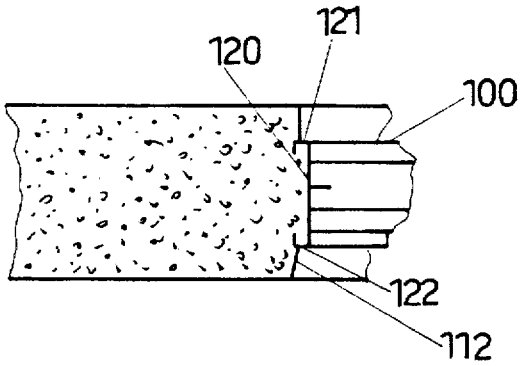
FIG. 8 is a sectional view taken on the line 8—8 of FIG. 6, showing the exterior joint surface of the peripheral concrete wall and the grout fixed vertical window sections is outward inclined.
Figure 9:
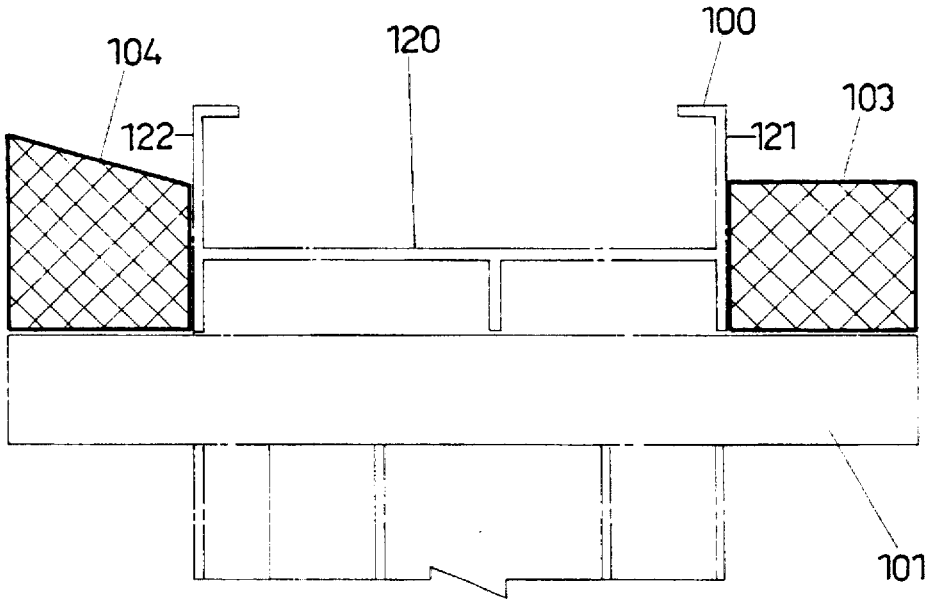
FIG. 9 shows the cross sectional view of the template sealing strips separately used at the interior and the exterior edges of a vertical section of the window frame to be grout fixed according to the present invention.

Please now refer to FIGS. 1 and 9, the vertical lining board 101 is designed to have a substantially n-shaped lower end having an interior leg 1011 and an exterior leg 1012 so that the vertical lining board 101 may be fitly straddled on the lower horizontal section 130*a*. The exterior leg 1012 downward extends longer length than the interior leg 1011. Moreover, the vertical lining board 101 has a width wider than that of the vertical section 120 of the window frame 100, so that template sealing strips 103 and 104 may be attached to two outer sides of the vertical lining board 101 and abut against the interior edge 121 and the exterior edge 122 of the vertical section 120, respectively. The attachment of the vertical lining boards 101 to the vertical sections 120 and the template sealing strips 103, 104 to the vertical lining boards 101 can be achieved by any conventional means, such as screws. The template sealing strip 104 is specially designed to have an outward inclined side opposite to the vertical lining board 101 so that a joint 112 of the peripheral concrete wall and the vertical section 120 of the window frame 100 is an outward inclined surface, as shown in FIG. 8, which makes the window more beautiful in the appearance. The outward inclined side of the template sealing strip 104 also allows the templates and the strip itself to be more easily removed from the set concrete.

It can be clearly seen from FIGS. 1, 4, 5, and 7, the vertical lining board 101 having a longer exterior leg 1012 and shorter interior leg 1011, together with the cooperating concrete templates provide an exterior joint 113 of the lower horizontal section 130*a* and the peripheral concrete wall which is lower than an interior joint 114 of the lower horizontal section 130*a* and the peripheral concrete wall. This outward and downward lowered bottom design of the window frame 100 prevents water from overflowing inward and therefore provides very good water permeance resistance and no other water-repelling works are needed around the periphery of the window frame 100.

Due to the upper supporting board 102 and the vertical lining boards 101 provided at the top and the two vertical inner sides of the window frame 100, respectively, the window frame 100 is not subject to any deformation by the pressure from the grouting concrete. The window frame 100 can maintain its straight shape when the concrete is set and the templates are removed.

Moreover, the template sealing strips 103, 104, and 105 are made of flexible rubber material and therefore, they can effectively seal the periphery of the window frame 100 and prevent the appearance of the window frame 100 from being stained, damaged, or corroded by concrete during grouting.

In brief, the advantages of the present invention over the conventional construction method for mounting window frames in a concrete-structured building include:

1. The concrete templates and the attached window frame together function like a moulding cavity, permitting the window frame to be securely inlaid in the concrete at a predetermined position in one-step concrete grouting.

2. In the event grouting concrete below the window frame is not sufficient, the opening left at the bottom of the window frame allows supplementary grouting of concrete.

3. The one-step grout fixed window frame is inlaid in the concrete wall which is waterproof.

4. The interior joint of the window frame and the concrete wall is higher than their exterior joint and therefore, water overflowing into the lower window frame can be prevented.

5. The construction method of the present invention can be easily practiced and the window frame can be located at any desired position on the external wall of the building.

6. Both the construction cost and term can be reduced.

It is to be understood that the present invention can also be employed to one-step grout fix door frames on the walls of a concrete-structured building.

What is claimed is:

1. A combined one-step grout fixed window frame and surrounding building structure, comprising:

a plurality of vertical lining boards, each of said plurality of vertical lining boards being affixed to an inner side of a respective vertical section of the window frame, each vertical lining board having a width wider than a width of the respective vertical section;

a plurality of pairs of vertical template sealing strips respectively coupled to said plurality of lining boards, each of said pairs of vertical template sealing strips being attached to a backside of a respective vertical lining board adjacent respective opposing outer edges thereof while abutting respective first and second edges of the vertical sections of the window frame to form a window frame assembly;

an upper supporting board fixed to a concrete template of an external wall of said building structure;

said window frame assembly being mounted on said upper supporting board for attaching said window frame assembly to the concrete template;

a pair of horizontal template sealing strips secured individually to respective first and second edges of an outer side of an upper horizontal section of the window frame;

a plurality of other corresponding concrete templates secured at predetermined positions to enclose said window frame assembly and form a complete molding cavity for receiving concrete grout therein.

* * * * *